US010239119B2

(12) United States Patent
Yamamoto et al.

(10) Patent No.: US 10,239,119 B2
(45) Date of Patent: Mar. 26, 2019

(54) APPARATUS FOR CONTINUOUS SLAB CASTING

(71) Applicant: SHINAGAWA REFRACTORIES CO., LTD., Tokyo (JP)

(72) Inventors: Kenji Yamamoto, Tokyo (JP); Atsushi Takata, Tokyo (JP); Mototsugu Osada, Tokyo (JP); Yoshihumi Shigeta, Tokyo (JP)

(73) Assignee: SHINAGAWA REFRACTORIES CO., LTD., Tokyo (JP)

( * ) Notice: Subject to any disclaimer, the term of this patent is extended or adjusted under 35 U.S.C. 154(b) by 0 days.

(21) Appl. No.: 15/751,646

(22) PCT Filed: Nov. 17, 2016

(86) PCT No.: PCT/JP2016/084037
§ 371 (c)(1),
(2) Date: Feb. 9, 2018

(87) PCT Pub. No.: WO2017/110319
PCT Pub. Date: Jun. 29, 2017

(65) Prior Publication Data

US 2018/0236530 A1 Aug. 23, 2018

(30) Foreign Application Priority Data

Dec. 25, 2015 (JP) ..... 2015-254017

(51) Int. Cl.
*B22D 11/103* (2006.01)
*B22D 41/56* (2006.01)
(Continued)

(52) U.S. Cl.
CPC ..... *B22D 11/103* (2013.01); *B22D 37/00* (2013.01); *B22D 41/24* (2013.01); *B22D 41/34* (2013.01);
(Continued)

(58) Field of Classification Search
CPC ..... B22D 11/0401; B22D 11/0408; B22D 11/103; B22D 41/50; B22D 41/507; B22D 41/56
See application file for complete search history.

(56) References Cited

U.S. PATENT DOCUMENTS 10,029,303 B2 * 7/2018 Yamamoto ..... B22D 41/56
2010/0242245 A1 9/2010 Yamamoto et al.
2017/0014898 A1 1/2017 Yamamoto et al.

FOREIGN PATENT DOCUMENTS

JP 5742992 B1 * 7/2015 ..... B22D 41/56

OTHER PUBLICATIONS

International Search Report dated Dec. 13, 2016 in International (PCT) Application No. PCT/JP2016/084037.

* cited by examiner

*Primary Examiner* — Kevin E Yoon
(74) *Attorney, Agent, or Firm* — Wenderoth, Lind & Ponack, L.L.P.

(57) ABSTRACT

The apparatus for continuous slab casting having a nozzle exchanging-holding mechanism capable of moving a submerged nozzle at the exchange of the nozzle through a moving-connecting space D of a base under a slide valve mechanism and keeping the connection between the submerged nozzle and the slide valve mechanism during the operation, and a rotation mechanism to rotate the base of the nozzle exchanging-holding mechanism, which is characterized by a fixing mechanism that fixes the submerged nozzle in the nozzle exchanging-holding mechanism by pressing the submerged nozzle toward one or both inner sides of the moving-connecting space D of the base in one or both directions perpendicular to the moving direction of the submerged nozzle during the nozzle exchange.

8 Claims, 6 Drawing Sheets

(51) Int. Cl.

| | |
|---|---|
| ***B22D 37/00*** | (2006.01) |
| ***B22D 41/24*** | (2006.01) |
| ***B22D 41/34*** | (2006.01) |
| ***B22D 41/40*** | (2006.01) |
| *B22D 11/04* | (2006.01) |
| *B22D 11/055* | (2006.01) |

(52) U.S. Cl.
CPC ..... *B22D 41/40* (2013.01); *B22D 41/56* (2013.01); *B22D 11/0401* (2013.01); *B22D 11/0408* (2013.01); *B22D 11/055* (2013.01)

APPARATUS FOR CONTINUOUS SLAB CASTING

TECHNICAL FIELD

The present invention relates to an apparatus for the continuous slab casting and, more specifically, to an apparatus for the continuous slab casting in which the molten metal in a slab mold is rotated and stirred by arbitrarily changing a discharge angle of the molten metal during the casting process.

BACKGROUND ART

In recent years, ingots (referred to also as strands) of steels or various kinds of alloys or the like are mass-produced generally by using a so-called "continuous casting method" which includes the steps of continuously injecting the molten metal in a melting state into a water-cooled mold and gradually drawing out solidified ingots from the mold.

In order to obtain high-quality ingots with less non-metallic inclusions and less component segregation by the above-described continuous slab casing, it is important to stir the molten metal in the middle of the solidification process as required. Also, the molten metal stirring in case of the slab that is larger in a cross-sectional area and moreover larger in length-to-width ratio of the cross-sectional shape (e.g., the ratio of the length of the longer side wall to the length of the shorter side wall being 5 or more) would be highly liable to such problem as occurrence of center segregation, center cross-sectional cracks as well as degradation of machinability, unlike the case of strands that are small in cross-sectional area and moreover nearly square in cross-sectional shape such as blooms or billets, for this reason there has been a need for stirring the molten metal as required.

Recently, as the life-span of submerged nozzles or the like becomes longer, the service life of the submerged nozzles or the like becomes durable to the casting with a plurality of ladles, which makes it possible to continuously cast the different kinds of steels and the strands of the cooling molds in different widths.

Various kinds of structures for stirring the molten metal as required have been proposed for a long time, but there is still no countermeasure enough to deal with the casting when the width or the thickness of the mold are changed.

The applicant of the present invention discloses the continuous slab casting apparatus, in Japanese Patent No. 5,742,992, wherein a rotational mechanism rotates a platform (hereinafter called a base) having a connecting mechanism (hereinafter called a nozzle exchanging-holding mechanism) connecting the submerged nozzle to a slide nozzle mechanism, together with the submerged nozzle, by a specific angle. According to such configuration, as well as the rotational flow can be obtained by keeping a discharge direction of the molten metal discharged from a discharge hole on a lower end of the submerged nozzle toward an objective direction of a longer side direction, it is possible to keep the rotational angle corresponding to the length and the thickness of the longer side.

FIG. 1 is a front view of the continuous slab casting apparatus disclosed in Japanese Patent No. 5,742,992, and FIG. 2 is a plan view (bottom view) of the apparatus looked up from a bottom. The conventional continuous slab casting apparatus is provided with a slide valve mechanism to adjust the flow quantity of the molten metal flowing into the mold, and the nozzle exchanging-holding mechanism to hold the submerged nozzle guiding the molten metal from the slid valve mechanism to the mold on a lower side of the slide valve mechanism and also to exchange an after-use submerged nozzle with an unused submerged nozzle. The continuous slab casting apparatus disclosed in Japanese Patent No. 5,742,992 is also provided with those mechanisms, and further provided with a nozzle rotational mechanism as described herein after.

The slide valve mechanism is placed between a housing 5 and a seal case 9 on a lower surface of a tundish 1, and its configuration is well-known, so undermentioned description refers only to necessary parts to the present invention. A slide plate 3*b* is placed between an upper plate 3*a* and a lower plate 3*c*, and slides by a hydraulic cylinder 7 for sliding, whereby the size of a molten steel hole made on each plate can be changed. Accordingly, it is possible to adjust the flow rate of the molten metal supplied from the tundish 1 through an upper nozzle 2, and supply the molten metal to a submerged nozzle 6 through a lower nozzle 4.

The lower nozzle 4 is placed at a position corresponding to the molten steel hole on the lower plate 3*c* of the seal case 9, and functions as a role of connecting the slide valve mechanism to the submerged nozzle 6.

The nozzle exchanging-holding mechanism is incorporated to the base 11 placed on a lower side of the seal case 9.

The base 11 is integrally formed by connecting two pieces 11*a* and 11*b* with a connecting bar 11*c*, wherein the pieces 11*a* and 11*b* are arranged on both directions (hereinafter referred to right and left directions, or right and left) perpendicular to a moving direction of the submerged nozzle 6 (hereinafter referred to a nozzle moving direction: an arrow direction of FIG. 2) at the exchange of submerged-nozzle. At a center of the right and left pieces 11*a* and 11*b*, a space (hereinafter referred to a moving-connecting space D) is arranged so as to move the submerged nozzle at the exchange of the submerged-nozzle and to be connected to the lower nozzle 4 at fixing (operating) the submerged nozzle 6. A right-and-left width of the moving-connecting space D is corresponding to a right-and-left width of a flange 15 on an upper end of the submerged nozzle 6, and a slide guide 14 is disposed on an inside of the moving-connecting space D along the nozzle moving direction. The flange 15 on the upper end of the submerged nozzle 6 is pressed against the lower surface of the lower nozzle 4 and held thereon, according to the undermentioned configuration.

On the both right and left sides of the moving-connecting space D under the lower surfaces of the right and left pieces 11*a* and 11*b* of the base 11, plural clampers 13 are supported by clamper pins along the nozzle moving direction, so as to position the tips of the clampers on the lower surface of the flange 15 of the submerged nozzle 6. Coil springs 12 attached on the base 11 are arranged on ends of the clampers 13, and the tips of the clamper 13 are biased upward. Accordingly, the lower side of the flange of the submerged nozzle 6 is biased upward at the tips of the clampers 13, and the upper end surface of the submerged nozzle 6 is tightly attached to the lower surface of the lower nozzle 4.

Furthermore, the continuous slab casting apparatus is configured so as to exchange an after-use submerged nozzle 6*e* with an unused submerged nozzle 6*n* by means of the nozzle exchanging-holding mechanism.

The nozzle exchanging-holding mechanism is configured so that the unused submerged nozzle 6*n* inserted from a guide rail 16 on an upstream side of the nozzle moving direction moves to a downstream side of the nozzle moving direction, and pushes out the after-use submerged nozzle 6*e* to the guide rail 16 on the downstream side. At this time, the connecting bar 11*c* of the base 11 is configured so as not to interfere with the moving of the submerged nozzle 6, as shown in FIG. 1.

In the conventional continuous slab casting apparatus, the base 11 is configured to be fixed on the seal case 9, but the apparatus disclosed in Japanese Patent No. 5,742,992 that the present invention presupposes is configured so as to allow the base 11 to rotate a specific angle by means of the rotation mechanism.

The base 11 is suspended from the seal case 9 by a support guide roller 22 and a support guide 21 so as to be rotatable around a center axis of the submerged nozzle 6, so that driving a driving device (hydraulic cylinder) 23 fixed on the seal case 9 under such condition can rotate the base 11 by a specific angle. Accordingly, the submerged nozzle 6 held by the nozzle exchanging-holding mechanism rotates, too, and the discharge direction of the molten metal from the discharge hole can be changed according to the conditions.

CITATION LIST

Patent Literature

Patent document 1: Japanese Patent No. 5,742,992

SUMMARY OF INVENTION

Technical Problem

When the continuous slab casting apparatus in the present invention is configured to be the same structure disclosed in the Japanese Patent No. 5,742,992, the discharge direction of the submerged nozzle 6 can be changed arbitrarily. At this time, it is desired that, ideally, the discharge direction changes accurately along with the motion of the driving device 23. However, since the submerged nozzle 6 and the lower nozzle 4 are designed so as to slide keeping the gas sealing property, the sliding surface receives the frictional resistance at the rotation of the submerged nozzle, and the submerged nozzle 6 receives the stress in the reverse direction to the driving direction of the submerged nozzle 6. On the other hand, when the submerged nozzle 6 is exchanged, since it is required that the unused submerged nozzle 6 is smoothly inserted between the right and left slide guides 14 (to the moving-connecting space D), the submerged nozzle 6 has a little clearance between the right and left slide guides 14. When the clearance is reduced, due to the different size of the flange of the submerged nozzle 6 caused by the manufacturing process, the problem occurs such that the submerged nozzle 6 cannot be inserted between the slide guides 14 (the pieces 11*a* and 11*b*).

The present invention is proposed in view of the above-mentioned conventional conditions, and has an object to provide with an apparatus capable of smoothly inserting the submerged nozzle (into the moving connecting space D) between the slide guides and moving accurately along with the motion of the driving device in order to change the discharge direction.

Solution to Problem

The present invention is assumed that an apparatus for continuous slab casting includes a slide valve mechanism, a submerged nozzle to guide molten metal from a tundish to a mold through the slide valve mechanism, a nozzle exchanging-holding mechanism to move the submerged nozzle through a moving-connecting space D provided to a base under the slide valve mechanism at the exchange of the submerged nozzle and to keep the connection between the submerged nozzle and the slide valve mechanism by pressing the submerged nozzle upward during the operation, and a rotation mechanism to rotate the base of the nozzle exchanging-holding mechanism.

In the apparatus for continuous slab casting, a fixing mechanism fixes the submerged nozzle in the nozzle exchanging-holding mechanism by pressing the submerged nozzle to an inside of the moving-connecting space D of the base and to a direction perpendicular to the moving direction of the submerged nozzle at the exchange of the submerged nozzle.

The fixing mechanism includes elastic materials or actuators provided to one of two pieces forming the moving-connecting space D. The fixing mechanism fixes the submerged nozzle by biasing one side surface of a flange of the submerged nozzle in the moving-connecting space D and pressing an other side surface of the flange against the inside of an other piece by means of the elastic materials or the actuators.

On tips of the elastic materials or the actuators, fixing members are attached in a direction parallel to the moving direction of the submerged nozzle, and the fixing members press one side surface of the flange of the submerged nozzle. Projections projecting to a direction perpendicular to the moving direction are provided on both ends on an abutting surface of the fixing members to the submerged nozzle in the moving direction, and the projections are provided with tapers on the upstream side and the downstream side of the moving direction of the submerged nozzle.

It is desirable that a biasing force of the fixing mechanism is 300 to 5000N (30 kgf to 500 kgf).

Advantageous Effects of Invention

According to the above-mentioned configuration, since the submerged nozzle is fixed by the fixing mechanism, when the rotation mechanism rotates the submerged nozzle by a specific angle in order to change the discharge direction of the submerged nozzle during the casting, the discharge direction can be changed to a desired discharge direction.

In addition, the biasing force of the fixing mechanism is set to a force (300 to 500N) enough that the fixing member can escape to the inverse direction to the biasing direction at the exchange of the submerged nozzle, so that the exchange of the submerged nozzle can be performed easily.

Moreover, the flow discharging through the submerged nozzle can be changed arbitrarily to a specific and desired direction during the casing, and it is possible to give the rotational flow to the molten metal. And where the discharge angle varies due to the accumulation of inclusions on the discharge hole and the mold changes in thickness and width, it is possible to ensure the appropriate discharge angle.

DESCRIPTION OF EMBODIMENTS

Figure 1:
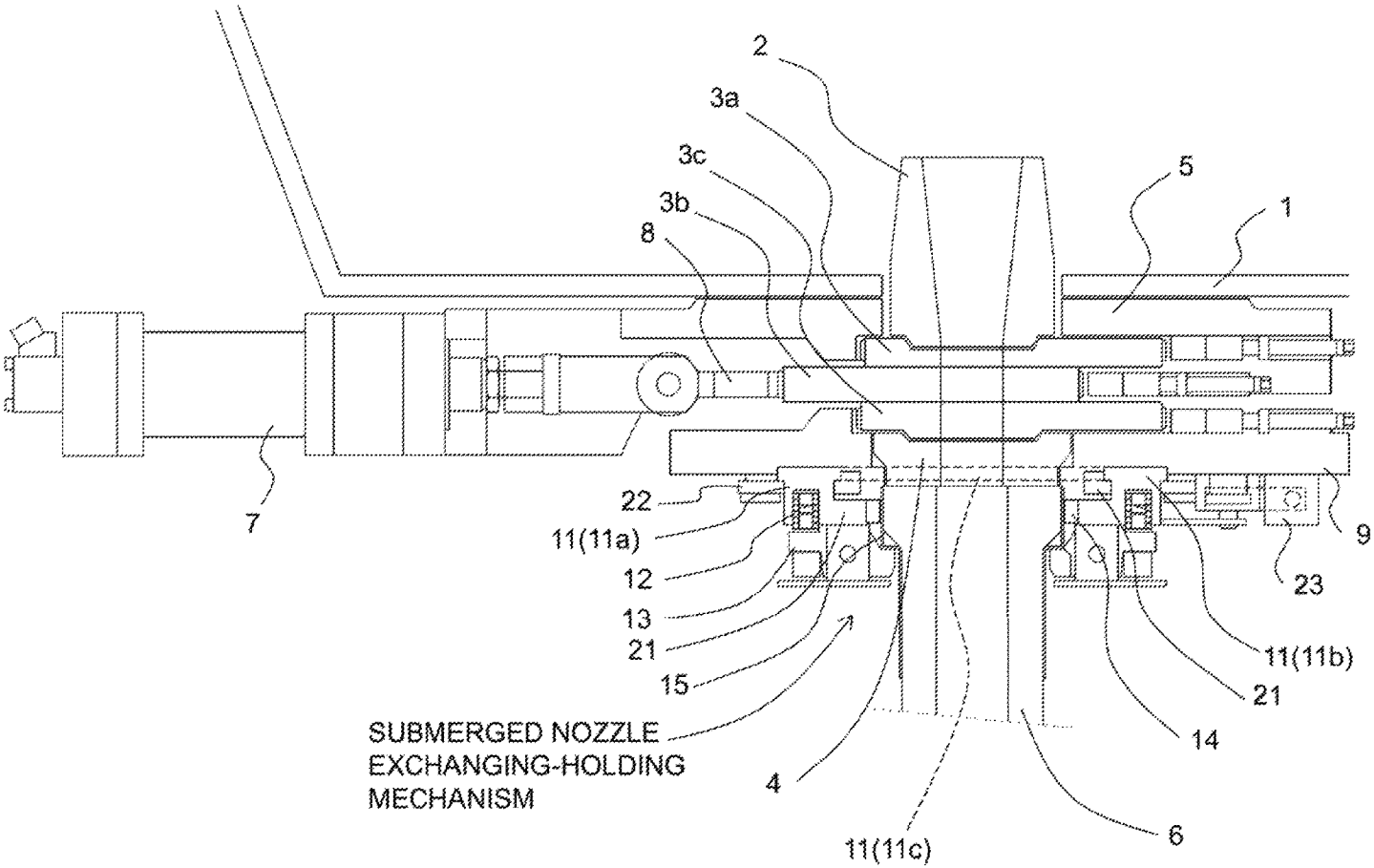
FIG. 1 PRIOR ART
FIG. 1 is a front view of a slide valve device provided with a conventional submerged nozzle exchanging-holding mechanism and a conventional submerged nozzle rotation mechanism.
Figure 2:
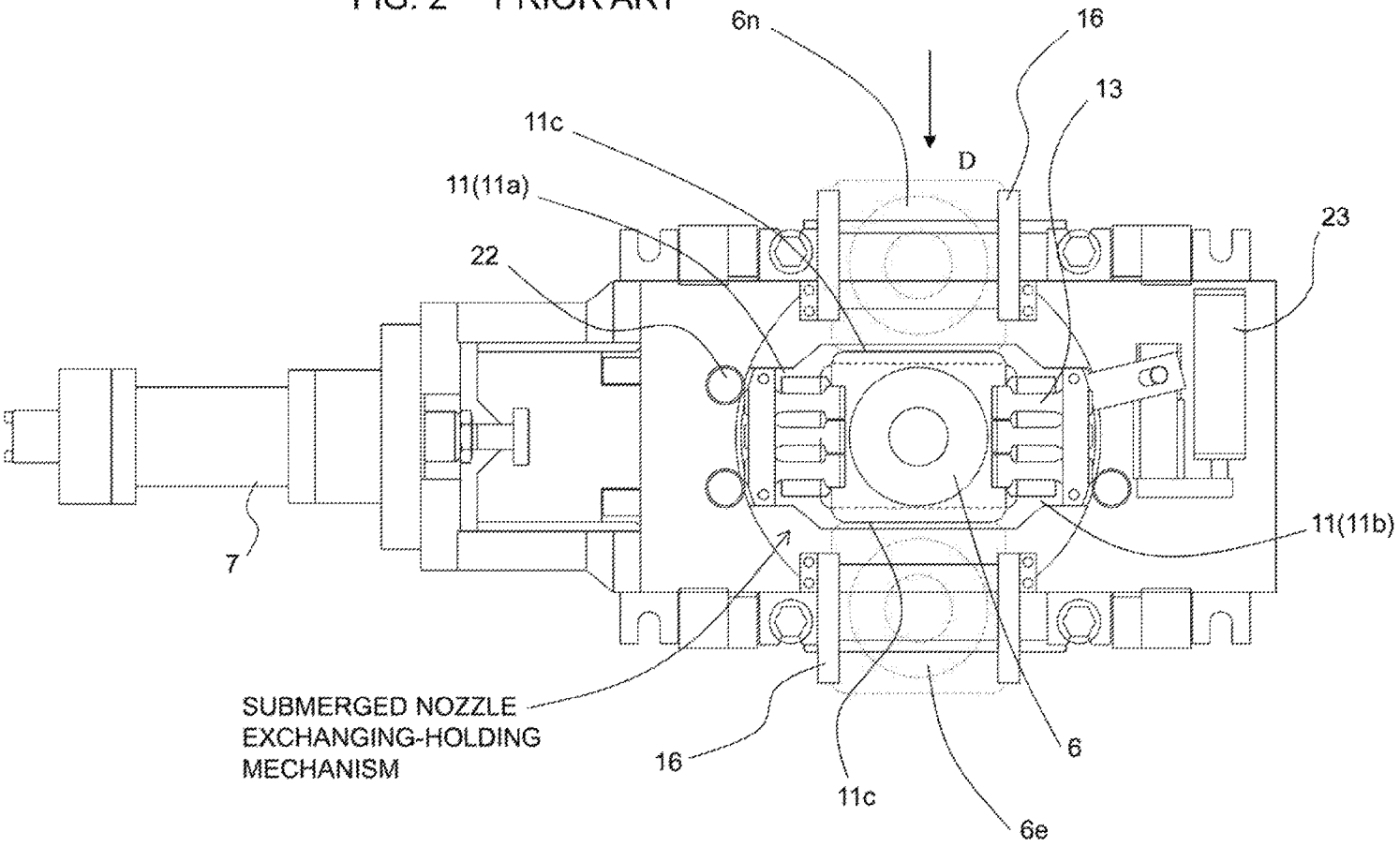
FIG. 2 PRIOR ART
FIG. 2 is a plan view (bottom view) of the slide valve device shown in FIG. 1.
Figure 3:
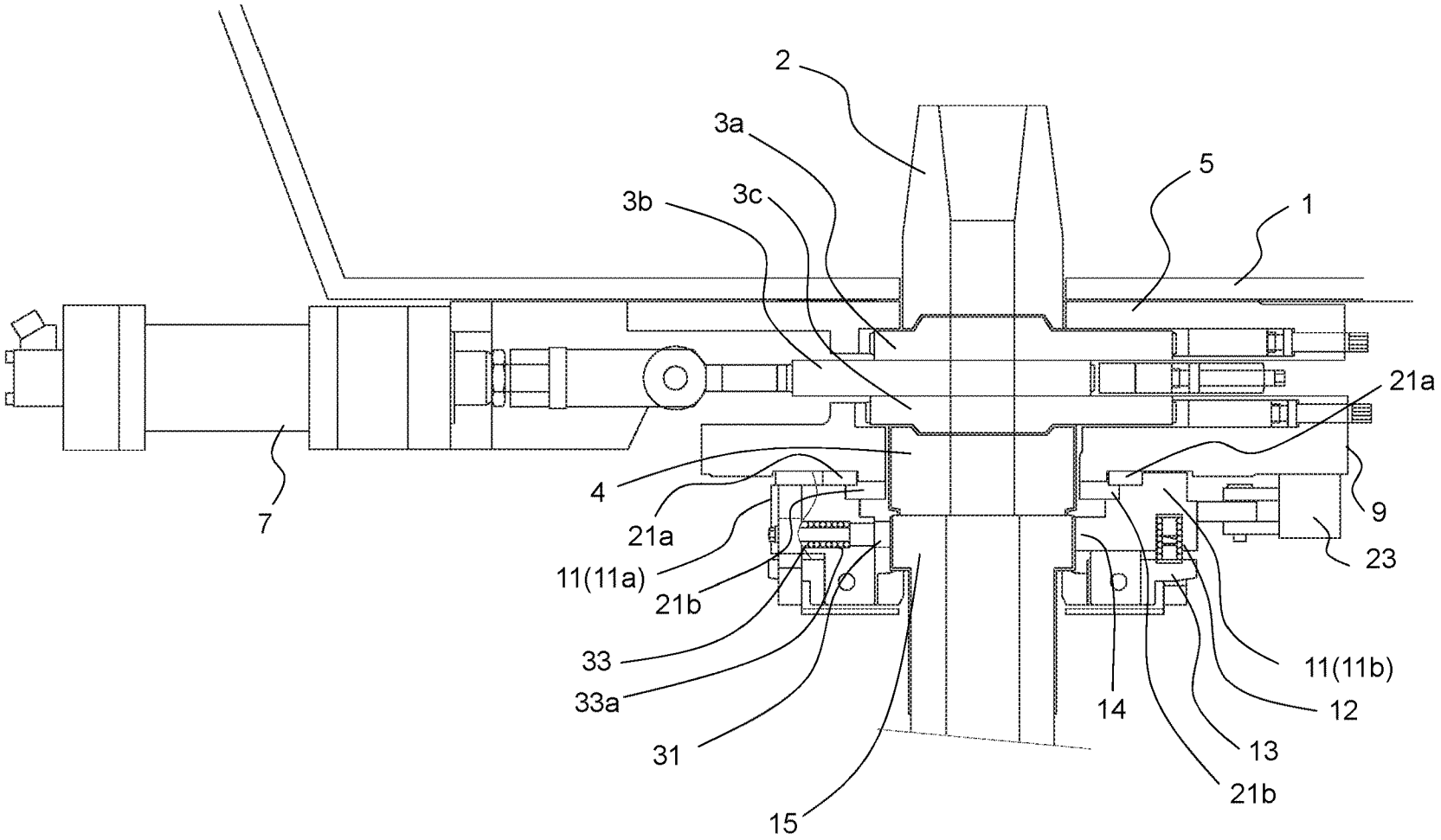
FIG. 3 is a front view showing an example of embodiments of the present invention.
Figure 4:
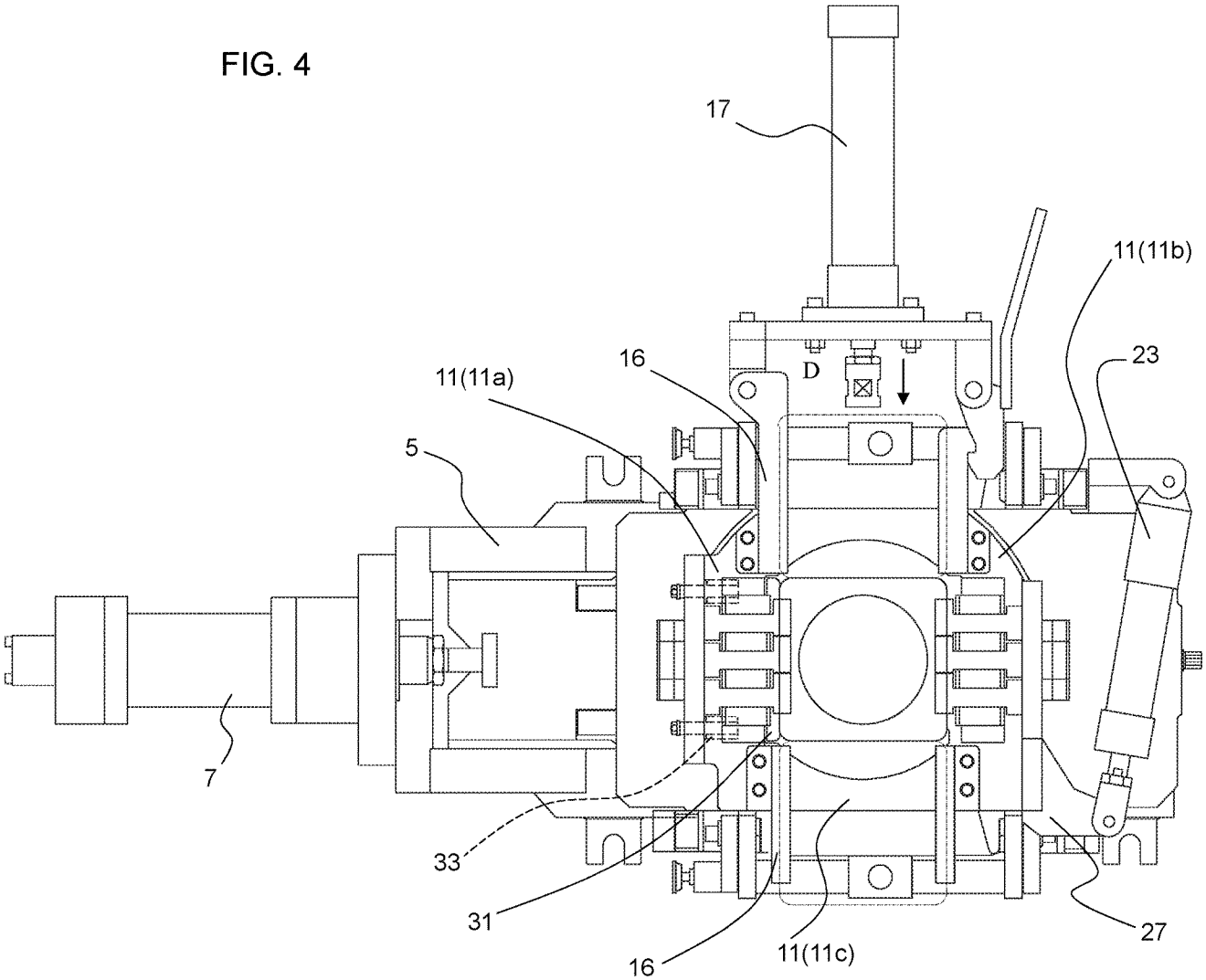
FIG. 4 is a plan view (bottom view) looked up from the lower side of the present invention.
Figure 5:
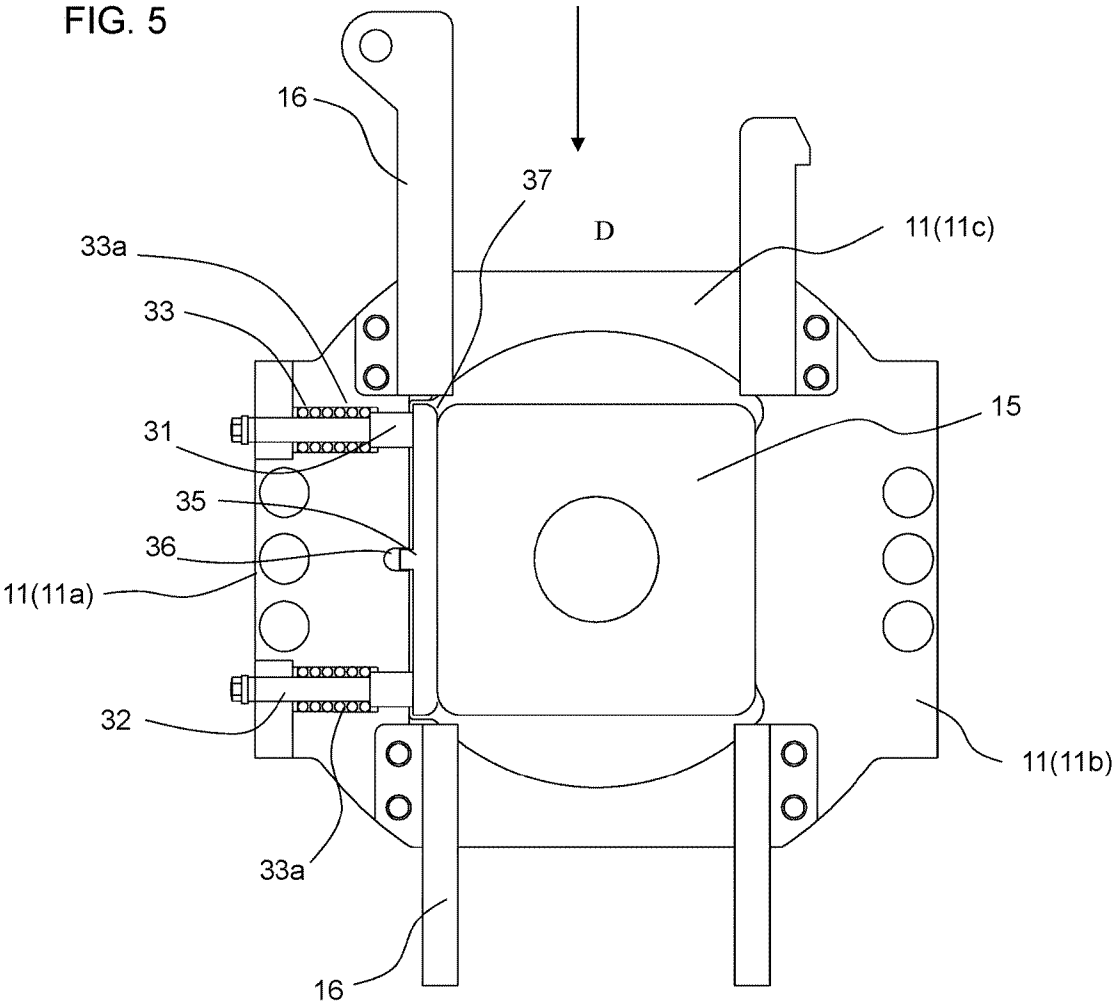
FIG. 5 is a cross sectional view of a portion of fixing a submerged nozzle of the present invention.

FIG. 3 is a front view showing an example of embodiments of the present invention, FIG. 4 is a plan view (bottom view) looked up from the lower side of the present invention, and FIG. 5 is a sectional view of a part of fixing a submerged nozzle. The prior art shown in FIG. 1 is configured that the base 11 of the nozzle exchanging-holding mechanism is held in the seal case 9 by the support guide roller 22, but embodiments of the present invention is configured as follows.

Basically, a ring-shaped support guide 21*a* is fixed on an upper end of the base 11, and a support guide 21*b* is fixed on a lower surface of the seal case 9 in a state that a part of the support guide 21*b* is engaged with the support guide 21*a*, so that the base 11 is rotatable by sliding the guides 21*a* and 21*b* mutually.

Specifically, a width of moving-connecting space D corresponding to an upper part of the base 11 covering the lower nozzle 4 is larger than the width of the flange of the submerged nozzle 6, through which the center part of the seal case 9 can been seen from the lower side. Moreover, a ring-shaped support guide 21*a* is fixed on the upper surface of the base 11, and a ring-shaped support guide 21*b* is fixed on the lower surface of the base 11, so as to project the support guide 21*b* from the lower surface of the seal case 9 to receive the support guide 21*a*, specifically, (in a state that the support guides 21*a* and 21*b* are engaged each other). Thereby, the base 11 is held rotatably by the support guide 21*a* and the support guide 21*b*. Like the conventional manner, the rotational force to the base 11 is given to the base 11 from the hydraulic cylinder 23 fixed on the seal case 9 through a lever 27.

Two pieces 11*a* and 11*b* are provided in the right and left directions of the base 11 that is a platform of the nozzle exchanging-holding mechanism. Two spring holes 33*a* are made on inside of the moving-connecting space D of the piece 11*a*, at two positions of upstream and downstream sides of the nozzle moving direction (an arrow direction in FIG. 5) toward the moving-connecting space D. Coil springs 33 are inserted in the spring holes 33*a* through volts (fixture legs 32) inserted in the spring holes 33*a*, and a fixing member 31 is provided on the two coil springs 33 over the nozzle moving direction. As shown in FIG. 5, the coil springs 33 are inserted to the volts 32, and attached with the fixing member 31 keeping a moving clearance so as to move in a specific width in the right and left directions. Accordingly, the fixing member 31 is biased in the right and left directions.

On the other hands, on the inside of the moving-connecting space D of the piece 11*b* of the base 11 on an opposite side to a side attached with the fixing member 31, a slide guide 14 is formed integrally with the piece 11*b* like the conventional manner. Thereby, when the submerged nozzle 6 is inserted in the moving-connecting space D, the fixing member 31 presses a side surface of the flange 15 of the submerged nozzle 6 against the right and left directions to push the slide guide 14 inside of the piece 11*b* to the opposite side. Thereby, the submerged nozzle 6 rotates by an angle corresponding to the motion of the driving device 23 when the submerged nozzle rotates.

At the exchange of the submerged nozzle, the submerged nozzle 6 is pushed to the moving direction. At this time, since the fixing member 31 is simply pressing the submerged nozzle 6 by appropriate force described hereinafter, the fixing member 31 can escape toward the direction inverse to the pressed direction, so that the submerged nozzle can be exchanged easily.

The number of the fixture legs 32 is two in FIG. 5, but it may be 1, or 3 or more. FIG. 5 shows an example using the coil springs 33, but the elastic material like plate springs, volute springs, or torsion springs may be employed instead of the coil springs 33. In addition, the fixing member 31 may be pressed by means of various kinds of actuators. As examples of the actuators, hydraulic cylinders, oil-hydraulic cylinders, pneumatic cylinders, solenoid valves can be used.

It is preferable that the biasing force to press the flange 15 of the submerged nozzle 6 by the fixing mechanism is 300N to 5000N (30 kgf to 500 kgf). In case of less than 300N, when the driving device for changing the discharge direction rotates the base 11, a sliding surface on the lower nozzle 4 receives the friction resistance, and cannot resist the stress working in the inverse direction to the driving direction, so that the fixing member 31 cannot fix the submerged nozzle, therefore it is not preferable. In case of 5000N and more, since the fixing member 31 does not escape even when the submerged nozzle is pushed to the nozzle moving direction at the exchange of the submerged nozzle, the nozzle exchange cannot be performed, therefore it is not preferable. More preferably, the biasing force is 1000N to 3000N.

Figure 6:
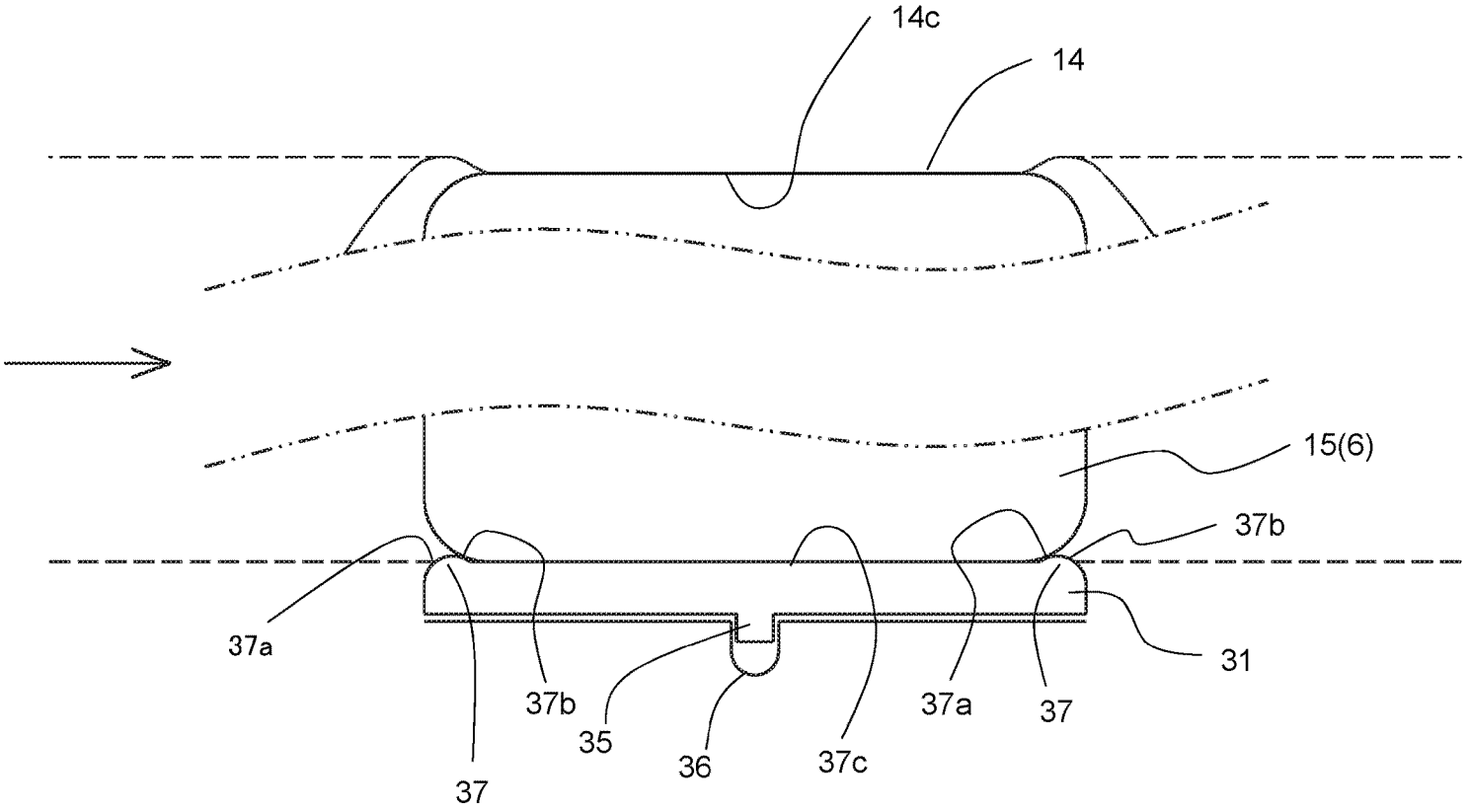
FIG. 6 is an enlarged view of a fixing member and a slide guide.

FIG. 6 is an enlarged view of the fixing member 31 of the fixing mechanism for pressing.

It is preferable that projections 37 are provided to the upstream side and downstream side of the fixing member 31, and moreover, tapers 37*a*, 37*b* are provided to the upstream side and the downstream side of the projections 37. Accordingly, the tapers 37*a*, 37*b* make a space between the fixing member 31 and the slide guide 14 on an approaching (withdrawing) side of the submerged nozzle 6, so that the flange 15 of the submerged nozzle 6 approaching from the upstream side of the moving direction (withdrawn to the downstream side of the moving direction) smoothly approaches (be withdrawn from) between the fixing member 31 and the slide guide 14.

An abutting surface 37*c* on the inside looked from a center of the fixing member 31 is formed to a shape along a periphery of the flange 15 of the submerged nozzle 6, and at the exchange of the submerged nozzle, the periphery of the flange 15 of the submerged nozzle 6 is mounted on the abutting surface 37*c* and the submerged nozzle 6 is fixed tightly.

The projections 37 provided to both ends of the fixing member 31 have an effect for preventing the submerged nozzle 6 from sliding off toward the moving direction at the rotating. On this account, a distance between the projections is set to a value close to a length in the moving direction of the flange of the submerged nozzle. The shape of the abutting surface 37*c* between the projections is not limited in particular, but it is preferable to be formed along with an R-chamfered surface where a corner of the periphery of the flange 15 is subjected to the R-chamfering, or to be formed along with a C-chamfered surface in case of the C-chamfering.

A height of the projection 37 is desired to be 1 to 5 mm. In case of 5 mm or more, a relief of the fixing member 31 becomes too large, and the submerged nozzle cannot be exchanged smoothly, therefore it is not preferable.

When the unused submerged nozzle 6*n* is set to the guide rails 16 of the nozzle exchanging-holding mechanism, it is better to make some clearance between the upstream side of the nozzle moving direction of the slide guide 14 and the downstream side of the flange 15 of the submerged nozzle 6. Due to the clearance, the setting of the submerged nozzle 6 is facilitated and the submerged nozzle can be moved easily. On the other hand, when the submerged nozzle 6 is held at a position to be used during the operation, it is preferable that the center of the submerged nozzle is positioned at a specific place, whereby the flange 15 of the submerged nozzle 6 is pressed and fixed on the slide guide 14 on the opposite side by the fixing mechanism.

According to the above description, it is configured as shown in the enlarged view of FIG. 6 that the abutting surface 14*c* at the center of the slide guide 14 abutting the flange 15 becomes a shape projecting a little to the moving-connecting space D, and the tapers are provided to the upstream side and the downstream side of the slide guide, whereby the submerged nozzle can be moved smoothly.

In addition, a configuration as shown in FIG. 5 and FIG. 6 is preferable, namely, a moving guide hole 36 for the fixing member 31 is provided to the piece 11*a* of the base 11, and a moving guide 35 that is a projection mounted by the moving guide hole 36 is provided to the fixing member 31, whereby the fixing member 31 can be configured to be prevented from moving the downstream direction along with the moving of the submerged nozzle 6 at the exchange of the submerged nozzle 6.

In the above description, the fixing member 31 is configured to be provided to one piece of the base 11, that is, the piece 11*a*, but it may be provided to both pieces, the pieces 11*a* and 11*b*, on the sides facing the nozzle moving space D. In this case, it is configured that the spring holes 33 are provided to the other side of piece 11*b*, and the coil springs 33 are inserted in the spring holes 33*a*, and the fixing member 31 is fixed by the coil springs 33. It is nevertheless to say that the slide guides 14 are replaced with the fixing member 31.

INDUSTRIAL APPLICABILITY

As described above, in the apparatus for the continuous slab casting in accordance with the present invention, the submerged nozzle can be tightly fixed on the base that is the plat form of the rotation mechanism when the direction of the discharge hole of the submerged nozzle is changed during the casting (operation), so that the direction can be changed to an accurate angle, and it is possible to perform the stirring of the molten metal appropriately according to the conditions of the mold. Therefore, it is possible to improve the quality of the strands.

REFERENCE SIGNS LIST

1 Tundish
2 Upper nozzle
3*a* Upper plate (plate brick)
3*b* Slide plate (plate brick)
3*c* Lower plate (plate brick)
4 Lower nozzle
5 Housing
6 Submerged nozzle
6*e* After-use submerged nozzle
6*n* Unused submerged nozzle
7 Hydraulic cylinder for sliding
8 Slide case
9 Seal case
10 Submerged nozzle exchanging mechanism
11 Base
12 Coil spring
13 Clamper
14 Slide guide
15 Flange of submerged nozzle
16 Guide rail
21*a* Support guide
21*b* Support guide
22 Support guide roller
23 Driving device (Hydraulic cylinder)
27 Lever
31 Fixing member
32 fixture legs
33 Coil spring
35 Moving guide
36 Moving guide hole
37 Projection

The invention claimed is:

1. An apparatus for continuous slab casting including a slide valve mechanism, a submerged nozzle to guide molten metal from a tundish to a mold through the slide valve mechanism, a nozzle exchanging-holding mechanism to move the submerged nozzle through a moving-connecting space D provided to a base under the slide valve mechanism at the exchange of the submerged nozzle and to keep the connection between the submerged nozzle and the slide valve mechanism by pressing the submerged nozzle upward during the operation, and a rotation mechanism to rotate the base of the nozzle exchanging-holding mechanism, the apparatus comprising:

a fixing mechanism to fix the submerged nozzle in the nozzle exchanging-holding mechanism by pressing the submerged nozzle to an inside of the moving-connecting space D of the base and to a direction perpendicular to the moving direction of the submerged nozzle at the exchange of the submerged nozzle, wherein the fixing mechanism comprises elastic materials or actuators provided to one of two pieces forming the moving-connecting space D, and fixes the submerged nozzle by biasing one side surface of a flange of the submerged nozzle in the moving-connecting space D and pressing an other side surface of the flange against the inside of an other piece by means of the elastic materials or actuators.

2. An apparatus for continuous slab casting, including a slide valve mechanism, a submerged nozzle to guide molten metal from a tundish to a mold through the slide valve mechanism, a nozzle exchanging-holding mechanism to move the submerged nozzle through a moving-connecting space D provided to a base under the slide valve mechanism at the exchange of the submerged nozzle and to keep the connection between the submerged nozzle and the slide valve mechanism by pressing the submerged nozzle upward during the operation, and a rotation mechanism to rotate the base of the nozzle exchanging-holding mechanism, the apparatus comprising:

a fixing mechanism to fix the submerged nozzle in the nozzle exchanging-holding mechanism by pressing the submerged nozzle to an inside of the moving-connecting space D of the base and to a direction perpendicular to the moving direction of the submerged nozzle at the exchange of the submerged nozzle, wherein the fixing mechanism comprises elastic materials or actuators respectively provided to two pieces forming the moving-connecting space D, and fixes the submerged nozzle by biasing a flange of the submerged nozzle in the moving-connecting space D from both sides by means of the elastic materials or actuators.

3. The apparatus for continuous slab casting according to claim 1, wherein fixing members are attached to tips of the elastic materials or the actuators in a direction parallel to the moving direction of the submerged nozzle, and the fixing members press one side surface of the flange of the submerged nozzle.

4. The apparatus for continuous slab casting according claim 3, wherein biasing force of the fixing mechanism is 300 to 5000N (30 to 500 kgf).

5. The apparatus for continuous slab casting according to claim 3, wherein projections projecting to a direction perpendicular to the moving direction of the submerged nozzle are provided on both ends on an abutting surface of the fixing member to the submerged nozzle in the moving direction, and the projections are provided with tapers on the upstream side and the downstream side of the moving direction of the submerged nozzle.

6. The apparatus for continuous slab casting according to claim 2, wherein fixing members are attached to tips of the elastic materials or the actuators in a direction parallel to the moving direction of the submerged nozzle, and the fixing members press both side surfaces of the flange of the submerged nozzle.

7. The apparatus for continuous slab casting according to claim 6, wherein biasing force of the fixing mechanism is 300 to 5000N.

8. The apparatus for continuous slab casting according to claim 6, wherein projections projecting to a direction perpendicular to the moving direction of the submerged nozzle are provided on both ends on an abutting surface of the fixing member to the submerged nozzle in the moving direction, and the projections are provided with tapers on the upstream side and the downstream side of the moving direction of the submerged nozzle.

* * * * *